US008210014B2

(12) United States Patent
Li et al.

(10) Patent No.: US 8,210,014 B2
(45) Date of Patent: Jul. 3, 2012

(54) FLEXIBLE FORMING DEVICE FOR FORMING THREE-DIMENSIONAL SHAPED WORKPIECES

(75) Inventors: Mingzhe Li, Changchun (CN); Zhiqing Hu, Changchun (CN); Zhongyi Cai, Changchun (CN); Wenzhi Fu, Changchun (CN); Chunguo Liu, Changchun (CN); Zhen Sui, Changchun (CN); Xiangji Cui, Changchun (CN); Yushan Deng, Changchun (CN); Gang Sun, Changchun (CN); Xiangji Li, Changchun (CN)

(73) Assignee: Jilin University, Jilin Province (CN)

( * ) Notice: Subject to any disclaimer, the term of this patent is extended or adjusted under 35 U.S.C. 154(b) by 833 days.

(21) Appl. No.: 12/279,449

(22) PCT Filed: Feb. 9, 2007

(86) PCT No.: PCT/CN2007/000464

§ 371 (c)(1),
(2), (4) Date: Dec. 16, 2008

(87) PCT Pub. No.: WO2007/095843

PCT Pub. Date: Aug. 30, 2007

(65) Prior Publication Data

US 2009/0107199 A1 Apr. 30, 2009

(30) Foreign Application Priority Data

| | | |
|---|---|---|
| Feb. 21, 2006 | (CN) | 2006 1 0016592 |
| Feb. 21, 2006 | (CN) | 2006 1 0016593 |
| Jan. 8, 2007 | (CN) | 2007 1 0055210 |
| Feb. 2, 2007 | (CN) | 2007 1 0055304 |

(51) Int. Cl.
*B21D 5/14* (2006.01)
*B60J 3/00* (2006.01)

(52) U.S. Cl. ..... 72/243.6; 72/173; 72/174; 72/178; 72/252.5

(58) Field of Classification Search ..... 72/166, 72/168, 170, 171, 173, 174, 177, 178, 212, 72/215, 241.8, 243.6, 252.5
See application file for complete search history.

(56) References Cited

U.S. PATENT DOCUMENTS

| | | | | |
|---|---|---|---|---|
| 4,770,017 | A * | 9/1988 | Yamashita et al. | 72/168 |
| 4,976,158 | A * | 12/1990 | Ginzburg et al. | 72/12.3 |
| 5,082,047 | A * | 1/1992 | Bricmont | 164/476 |
| 5,341,664 | A * | 8/1994 | Noe et al. | 72/161 |
| 6,332,644 | B1 * | 12/2001 | Ito et al. | 296/215 |
| 7,065,999 | B2 * | 6/2006 | Fukuchi et al. | 72/171 |

FOREIGN PATENT DOCUMENTS

| | | |
|---|---|---|
| CN | 1167695 | * 12/1997 |
| CN | 1385299 | * 12/2002 |
| CN | 1539568 | * 10/2004 |

* cited by examiner

*Primary Examiner* — David Jones
(74) *Attorney, Agent, or Firm* — Jenkins, Wilson, Taylor & Hunt, P.A.

(57) ABSTRACT

A flexible forming device for forming three-dimensional shaped workpieces, comprising a frame, at least two working rollers, one or more working roller driving mechanisms and one or more adjusting mechanisms, wherein the working rollers, the one or more working roller driving mechanisms and the one or more adjusting mechanisms are installed on the frame respectively. At least one of the working rollers is a flexible working roller, which is bendable and adjustable. The forming device need not use mold and can realize the continuous formation of a three-dimensional curved surface of a plate-shaped workpiece, and the gradual formation of a tube-shaped or bar-shaped three-dimensional shaped workpiece. The forming device can save manpower, material and time.

14 Claims, 11 Drawing Sheets

FLEXIBLE FORMING DEVICE FOR FORMING THREE-DIMENSIONAL SHAPED WORKPIECES

FIELD OF THE INVENTION

The present invention relates to a flexible forming device for forming three-dimensional shaped workpieces, which belongs to the field of plastic forming.

BACKGROUND OF THE INVENTION

At present, the forming of three-dimensional shaped workpieces, such as plate-shaped, tube-shaped and bar-shaped workpieces, is realized by various press machines or specialized machine tools with the assistance of specialized dies. The completion of each type of shaped workpieces requires a set or sets of dies. The designing, manufacturing and adjusting of these dies consumes a great amount of manpower, material resource as well as time. Moreover, the traditional forming device for forming three-dimensional shaped workpieces is automated to a low degree, thus its efficiency cannot meet the need of modernized industrial production. In addition, manual forming, which is unsatisfactory with its poor forming quality, low manufacturing efficiency and requirement of intensive labor, is mainly used for forming workpieces which are large in size and small in quantity.

In addition, without specialized dies, the continuous forming devices adopting current technologies can only form workpieces with straight generatrixes, such as various sheets, strips and profiles, while the forming of three-dimensional shaped workpieces is achieved mainly through die forming or manual production. When it is required to form tube-shaped or bar-shaped workpieces, especially those with varying diameters, special techniques such as spinning, roll forging as well as cross-wedge rolling, are usually applied, which have a much high cost and require a long processing period. Moreover, workpieces with different shapes require different dies when using various forming devices, thus urging a long preparation cycle with a lot of manpower, material resource consumed and a low degree of automation, which could not meet the need of modernized production of small quantity.

SUMMARY OF THE INVENTION

In view of the above facts, an object of the present invention is to change the traditional forming process using special dies to form three-dimensional workpieces, and provide a flexible forming device for forming three-dimensional shaped workpieces based on a technology of bendable flexible roll forming, which can fulfill the forming of many types of three-dimensional shaped workpieces, such as plate-shaped, tube-shaped and bar-shaped workpieces, etc. Compared with the traditional die forming technology, the flexible forming device can greatly reduce the production cost, increase the production efficiency, and thus achieve automatic control in a more convenient way.

To achieve the above object, the present invention provides a flexible forming device for forming three-dimensional shaped workpieces, comprising a frame, at least two working rollers, one or more working roller driving mechanisms and one or more adjusting mechanisms. The at least two working rollers, the one or more working roller driving mechanisms and the one or more adjusting mechanisms are installed on the frame, respectively, so that a blank to be formed can be clamped between the working rollers. The blank can be formed into a three-dimensional shaped workpiece under the rolling action of the working rollers, wherein at least one of the working rollers is a flexible working roller, which is bendable and adjustable.

The flexible forming device in the present invention adopts at least two working rollers, which can be arranged according to certain rules, to perform a forming process of three-dimensional shaped workpieces, such as plate-shaped, tube-shaped and bar-shaped workpieces, etc. In the present invention, the relative position between the working rollers as well as the bendable axis of the flexible working roller can be adjusted by the adjusting mechanism, and can be located at any selected position. Therefore, it can form any type of three-dimensional workpieces in accordance with the shape of workpieces required. Elastic materials such as steel wire flexible axle, spring, steel wire flexible axle-polyurethane, spring-polyurethane and polyurethane, etc. can all be applied to the flexible working roller. The working rollers can be divided into active rollers, passive rollers and brake rollers. The active rollers drive the workpiece to be formed to pass through between the working rollers by the driven rotation of the active rollers. The passive rollers are brought into rotation by the formed workpiece. The brake rollers are not able to rotate in a braked state but can be brought into rotation by the formed workpiece in the same way as the passive rollers in a non-braked state.

The working roller driving mechanism can be a regular transmission mechanism such as a gear mechanism, a hydraulic mechanism, etc. In addition, an anti-distortion device and an anti-loose device can be installed on the non-forming area of the flexible working roller.

The position change of the working rollers and the curvature change of workpiece forming can be achieved through mechanical or Numerical Control (NC) means, which can also be applied to the rotation of the working rollers and one or more workpiece clamping and spinning mechanisms.

Advantageously, the flexible working roller is made of one or more materials selected from steel wire flexible axle, helical spring, steel wire, polyurethane rubber, etc.

Advantageously, the flexible working roller is an integral working roller or a segmented working roller. The segments in the segmented working roller rotate synchronously or asynchronously, in the same or opposite direction.

Advantageously, one or more workpiece clamping and spinning mechanisms whose rotatable parts can rotate actively or passively are arranged at an end of the integral working roller or between the segments of the segmented working roller.

Advantageously, the flexible forming device is used for forming a tube-shaped workpiece, and comprises two flexible working rollers, one of which is located outside the tube-shaped workpiece, and the other one of which is located inside the tube-shaped workpiece.

Advantageously, the flexible working roller located inside the tube-shaped workpiece is configured to be a passive bendable roller or a simple elastic roller, so as to simplify the structure of the inside working roller and eliminate the need for adjustment.

Advantageously, the flexible forming device is used for forming a tube-shaped or bar-shaped workpiece, and comprises at least two flexible working rollers, all of which are located outside the workpiece in the circumferential direction, and the workpiece undergoes a diameter shrinking deformation along with the self-rotation and centripetal movement of the flexible working rollers.

Advantageously, the flexible forming device is used for forming a tube-shaped workpiece, and comprises at least two flexible working rollers, all of which are located inside the tube-shaped workpiece in the circumferential direction, and the workpiece undergoes a diameter expanding deformation along with the self-rotation and centrifugal movement of the flexible working rollers.

Advantageously, a plurality of adjusting mechanisms with adjustable height for supporting and adjusting the axis position and bendable degree of the flexible working roller are arranged on the bendable and adjustable flexible working roller, and the adjustment of the adjusting mechanism is achieved through pre-adjustment before the forming is started or consecutive adjustment whenever necessary during the forming process.

Advantageously, an open bearing is installed on an end of an adjusting rod of the adjusting mechanism, so as to adjust and support the flexible working roller, and the open bearing can swing its head in accordance with the change of the bending contour tangent of the flexible working roller.

Advantageously, the working roller driving mechanism is arranged on one or both ends of the working roller.

Advantageously, the flexible working roller consists of a plurality of sub-rollers with mutual independence, adjustable axis position, swayable axis angle (for example, the axis angle of the sub-roller can be swayed freely in accordance with the change of the transverse curvature of the workpiece), and the sub-rollers can be constructed as, according to the requirement, active sub-rollers, passive sub-rollers or brake sub-rollers. The sub-rollers can be displaced so that their positions are adjusted under the action of the adjusting mechanism, and can rotate through a certain angle and be located at any position, thus different curvatures in the longitudinal and transverse directions of the workpiece can be obtained through the change of relative position between the working rollers, the displacement or rotation of the sub-rollers of the working rollers. The change of the relative position between the working rollers and the displacement of the sub-rollers can be achieved through mechanical or hydraulic driving devices. In addition, the surface of the sub-roller can be made of steel or other metal materials, and polyurethane rubber sleeves can be attached to the surface of the sub-roller.

The flexible forming device in the present invention can be used to replace the traditional dies to realize the flexible forming task of various workpieces such as plate-shaped, tube-shaped and bar-shaped workpieces, etc. With reference to the flexible and changeable characteristics of the multi-point forming technology, the traditional two-dimensional forming technology and multi-roller forming technology, the flexible forming device in the present invention makes the straight rollers in the traditional forming device or the multi-roller forming device flexible. Thereby, the working rollers can be deformed flexibly in the longitudinal and transverse directions (with their axes bendable and adjustable). The bending of the working rollers can be achieved manually (adjusted before the forming process and remain unchanged throughout the process) or by an automatic adjustment under the control of a computer (adjusted before or during the forming process automatically). The degree of deformation or bending can be determined by the shape of the three-dimensional workpieces. This kind of forming can achieve consecutive forming of three-dimensional shaped workpieces, and yet compared with the traditional forming device using dies, the flexible forming device in the present invention has the following advantages: no requirement for special design, manufacture and adjustment of dies; a low manufacturing cost; a shortened preparation period for production; savings in manpower, material resource and time; and increased production efficiency.

BRIEF DESCRIPTION OF THE DRAWINGS

The present invention will be better appreciated from the following description in more details made with reference to the illustrative embodiments shown in the drawings, in which.

DETAILED DESCRIPTION OF THE PREFERRED EMBODIMENTS

Figure 1A:
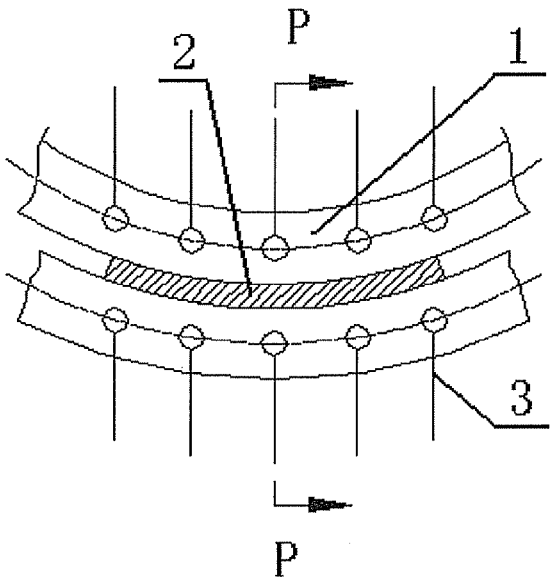
FIG. 1*a* is a schematic view of a three-roller flexible forming device according to a first embodiment of the present invention.

First of all, referring to FIGS. 1*a*-8, a flexible forming device according to the first embodiment of the present invention, which is mainly used for forming plate-shaped three-dimensional workpieces, will be described.

As shown in these figures, the flexible forming device adopts at least two working rollers arranged according to certain rules, so as to achieve a different curvature shape in the longitudinal direction of a plate-shaped workpiece (referred to "sheet" hereinafter) through the change of the relative position between the working rollers, and achieve different curvature forming in the transverse direction of the sheet through the deformation of the axis of the bendable working roller(s). In in the case where the relative position between the working rollers can be changed, and the shape of the axes of the working rollers can be adjusted, the consecutive forming condition for plate-shaped three-dimensional workpieces can be fulfilled. Thereby, if a sheet is led through between the working rollers under the rotation of the active roller, the object of sheet forming can be achieved. The change of relative position between the working rollers and the bending of the axis of the working roller can both be achieved through mechanical or hydraulic driving devices, etc. Workpieces with different curvatures can be formed as a result of the change of the relative position between the working rollers and different degrees of shape adjustment of the axes of the working rollers. Depending on different types of three-dimensional plate-shaped workpieces, the change of the relative position between the working rollers and the bending state of the axes of the working rollers can both be adjusted by mechanical means and by a computer, so as to fulfill the flexible forming of plate-shaped workpieces.

As shown in FIGS. 1*a*-3*b*, according to a first embodiment, the flexible forming device of the present invention comprises a frame (not shown), at least two working rollers, one or more working roller driving mechanisms (not shown), and one or more adjusting mechanisms 3, wherein the working rollers, the working roller driving mechanism(s) and the adjusting mechanism(s) are all installed on the frame. A blank to be formed (a plate-shaped workpiece or sheet 2 here) can be clamped between the working rollers, so as to undergo a plastic forming process under the rolling action of the working rollers, wherein at least one of the working rollers is a flexible working rollers, which is bendable and adjustable. The frame can be set up in various forms as well-known in the art in accordance with an actual requirement, so the detailed description on the frame is omitted here. The working roller driving mechanism can be a normal transmission mechanism, such as a gear mechanism, a hydraulic mechanism, etc. The flexible working roller can be made of one or more materials selected from steel wire flexible axle, helical spring, steel wire and polyurethane rubber. One or a plurality of adjusting mechanisms 3 used to support the flexible working roller and to adjust the position of the axis and bending degree are provided on the flexible working roller, wherein the adjusting mechanism 3 of the flexible working roller can be adjusted through pre-adjustment or consecutive adjustment during the forming process whenever necessary.

Figure 1B:
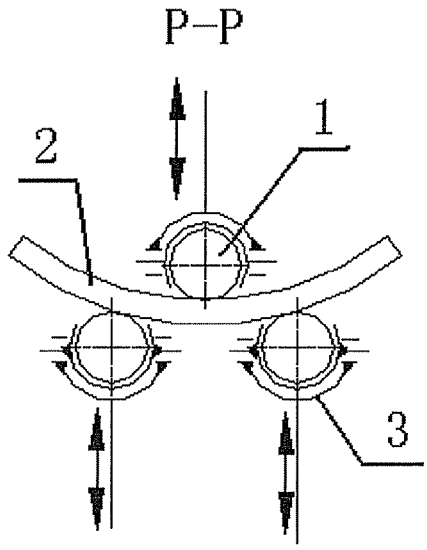
FIG. 1*b* is a P-P direction view of FIG. 1*a;*

The flexible forming device as shown in FIG. 1*a* and FIG. 1*b* comprises three flexible working rollers 1, which are arranged as shown in FIG. 1*b*. The axis of the flexible working roller 1 can be adjusted through the adjusting mechanism 3 before or during the forming process. The axis of the flexible working roller 1 is presented in a bending state during the forming process, and when passing through between the flexible working rollers, the plate-shaped workpiece is deformed in the transverse direction under the shape-adjusting function of the axes of the working rollers (see FIG. 1*a*). In the meantime, it is deformed in the longitudinal direction under the pressures provided by the three flexible working rollers (by means of the change of the relative position) (see FIG. 1*b*). All the three flexible working rollers 1 can be active rollers; or any one or two of them can be active rollers, and the other(s) can be passive roller(s); or at least one of the passive rollers serves the function of a brake roller.

Figure 2A:
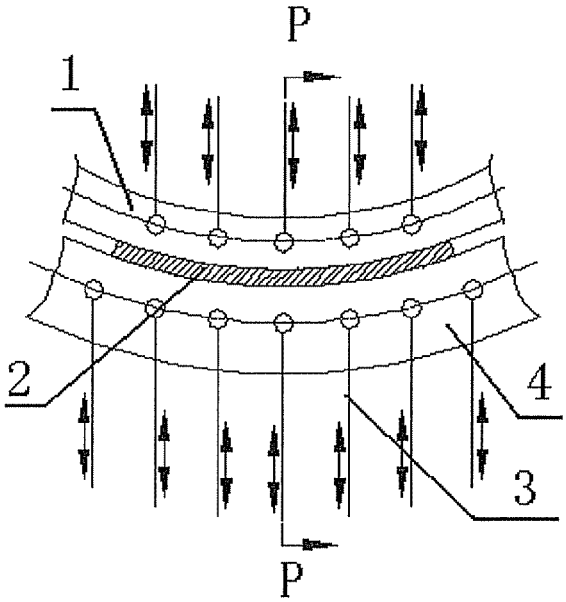
FIG. 2*a* is a schematic view of a two-roller flexible forming device according to the first embodiment of the present invention.
Figure 2B:
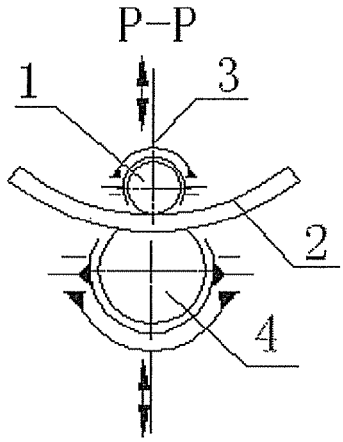
FIG. 2*b* is a P-P direction view of FIG. 2*a;*

The flexible forming device as shown in FIG. 2*a* and FIG. 2*b* comprises two flexible working rollers 1 and 4, i.e., an upper roller (the smaller working roller) and a lower roller (the larger working roller), which are arranged as shown in FIG. 2*b*. The axes of the flexible working rollers can be adjusted under the action of the adjusting mechanisms 3 during or before the forming process. During the forming process, the axis of the flexible working roller 1 is presented in a bending state. When the plate-shaped workpiece passes through between the flexible working rollers, it is deformed in the transverse direction under the action of the adjusting function of the axis of the flexible working roller (see FIG. 2*a*). In the meantime, the lower roller is locally deformed under the action of the upper roller, thus causing a deformation of a part of the workpiece which sticks to the surface of the lower roller (see FIG. 2*b*).

Advantageously, a polyurethane rubber sleeve is attached to the lower roller or the lower roller is composed of polyurethane rubber and the diameter of the lower roller is larger than that of the upper roller. Both the upper roller and the lower roller can be made to be active, or one of them can be made to be active and the other one can be made to be passive.

Figure 3A:
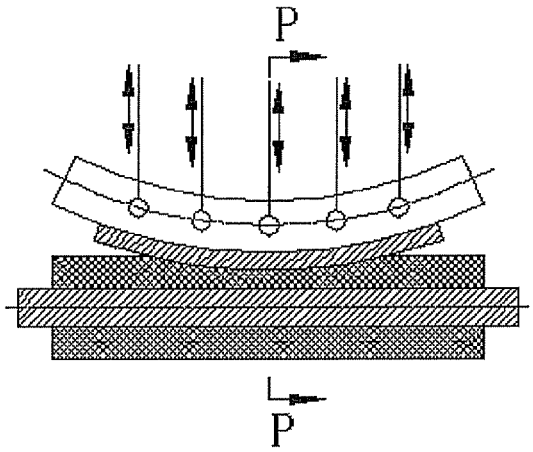
FIG. 3*a* is a schematic view of another type of two-roller flexible forming device according to the first embodiment of the present invention.
Figure 3B:
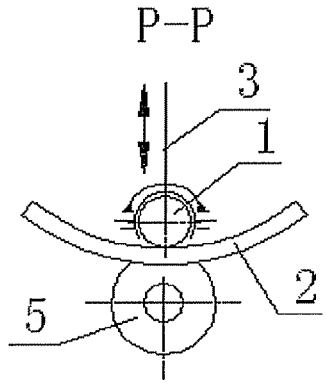
FIG. 3*b* is a P-P direction view of FIG. 3*a;*
Figure 4:
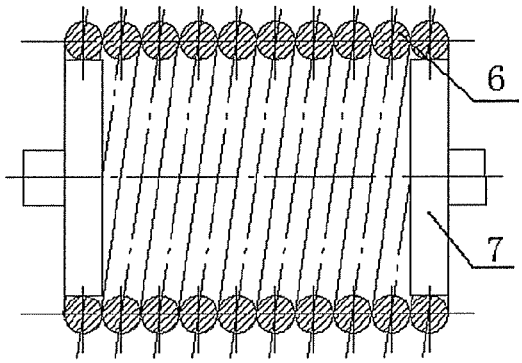
FIG. 4 is a schematic view of a flexible working roller composed of a helical spring.
Figure 5:
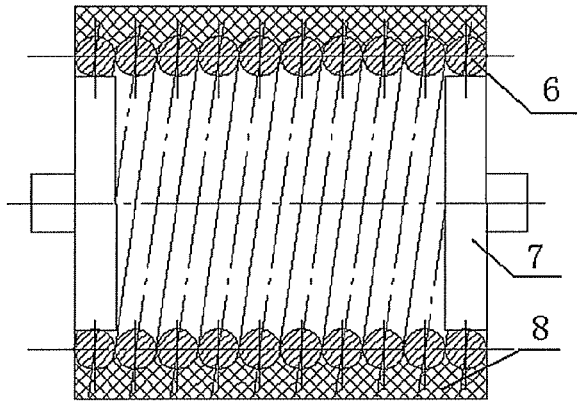
FIG. 5 is a schematic view of a flexible working roller composed of a helical spring and a polyurethane rubber sleeve.
Figure 6:
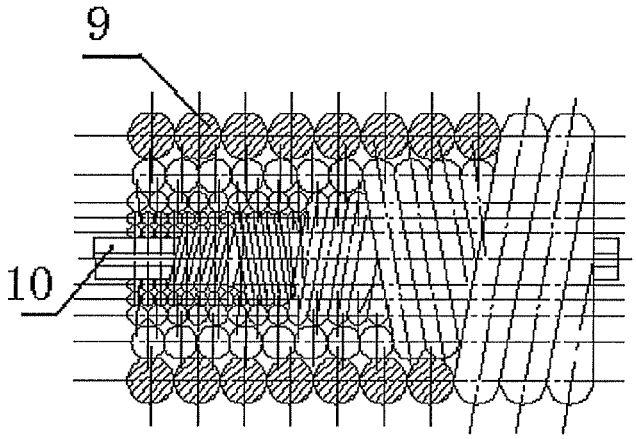
FIG. 6 is a schematic view of a working roller with a steel wire flexible axle.
Figure 7:
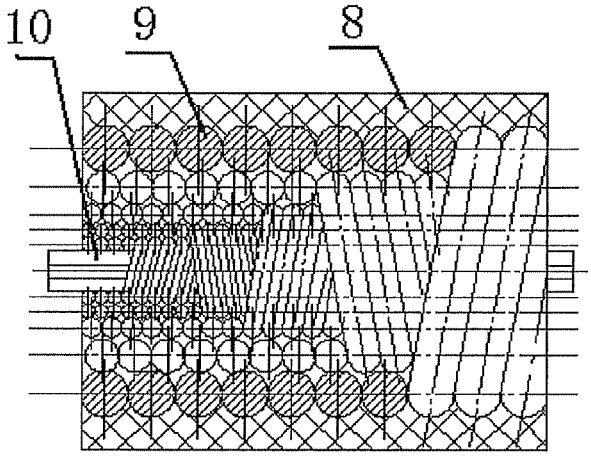
FIG. 7 is a schematic view of a flexible working roller composed of a steel wire flexible axle and a polyurethane rubber sleeve.

The flexible forming device as shown in FIG. 3*a* and FIG. 3*b* comprises two working rollers 1 and 5, i.e., a smaller working roller and a larger working roller, which are arranged as shown in FIG. 3*b*. The smaller working roller is a flexible working roller which is bendable, and the larger working roller is a cylindrical elastic roller whose diameter is larger than that of the smaller working roller. Both the smaller and the larger working rollers can be made to be active rollers, or one of them can be made to be active and the other one can be made to be passive. The axis of the smaller working roller can be adjusted under the action of the adjusting mechanism during or before the forming process, and remain in a bending state during the forming process. Under the action of the smaller working roller, the shape of the larger working roller can be deformed but its axis can remain straight. When passing through between the smaller and larger working rollers, the plate-shaped workpiece is deformed in the transverse direction under the shape-adjustment action of the axis of the smaller working roller and the axially shape-adjustment action of the larger working roller (see FIG. 3*a*). In the meantime, under the action of the smaller working roller, the larger working roller undergoes a radial deformation. Thus, the workpiece is deformed in the longitudinal direction, and a deformation is caused of a part of the workpiece which sticks to the surface of the larger roller (see FIG. 3*b*).

Figure 8:
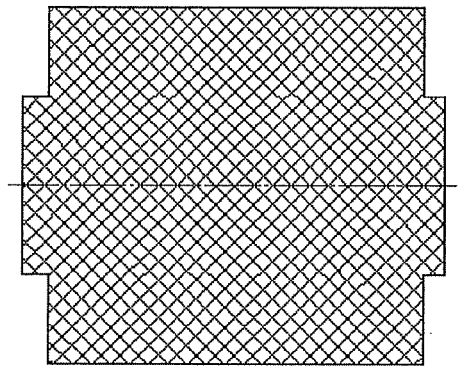
FIG. 8 is a schematic view of a flexible working roller composed of polyurethane rubber.

Through the flexible forming devices as mentioned above, a plate-shaped workpiece 2 can be rolled into various shapes as required by the working rollers. This type of forming device needs no die, however, controlling of the working rollers is required during the forming process. The working rollers 1 and 4 can be constricted in the manners as shown in FIGS. 4, 5, 6, 7 or 8; the working roller 5 can be constructed in the manner as shown in FIG. 8.

In the present invention, the more working rollers there are, the better the effect of the forming will be, and there can be a variety of other rules for the arrangement of the working rollers other than those shown in FIGS. 1, 2 and 3, and the working rollers can also be arranged in accordance with the actual requirement.

Moreover, the more the adjusting mechanisms for the working rollers are involved, the better the effect of the forming will be.

The flexible forming device according to the second embodiment of the present invention, which is also used for forming three-dimensional plate-shaped workpieces, will be described below with reference to FIGS. 9-15. This flexible forming device is basically similar in structure to that of the first embodiment, except that the flexible working rollers can be classified into two types: integral and segmented ones, while the latter can rotate synchronously or asynchronously, in the same or opposite direction. In addition, a variety of assistant mechanisms providing reliable control and adjustment for this flexible forming device are also set up respectively.

Figure 9:
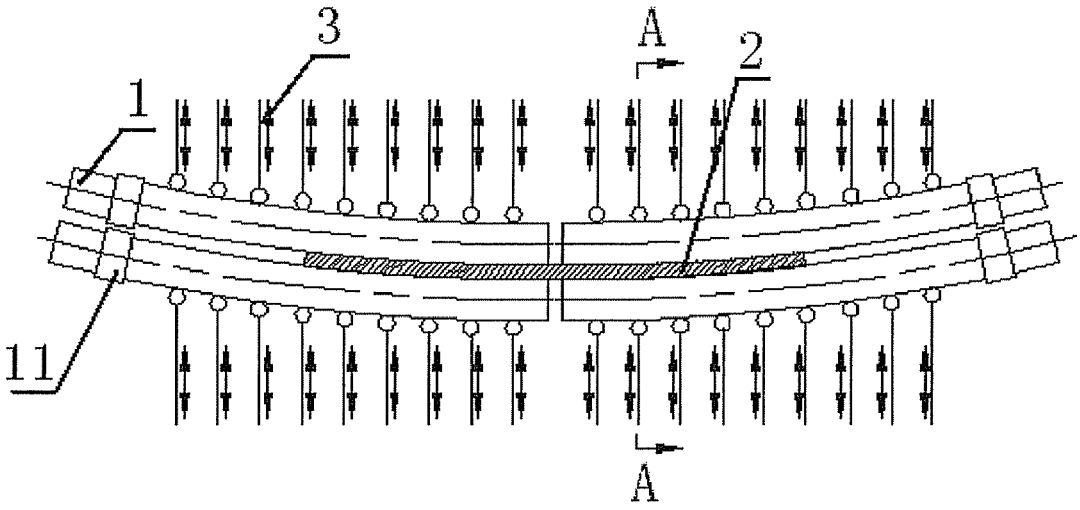
FIG. 9 is a schematic view of a flexible forming device composed of three bendable working rollers according to a second embodiment of the present invention, wherein each of the bendable working rollers is segmented into two segments.

In the embodiment of FIG. 9, an adjusting rod 14 (see FIG. 14) of the adjusting mechanism 3 can be regulated by manual control or a numerical control system according to the three-dimensional shape required by the plate-shaped workpieces, so that the open bearing 13 (see FIG. 14) pulls or presses the flexible working roller 1 and causes it to bend. An expansion unit can be set on one or both ends of the flexible working roller, to ensure its free expansion and contraction during the adjusting process. The working roller can be fixed after being adjusted to prevent further relative displacement in the axial direction and circumferential direction. In the meantime, to facilitate the deformation of the flexible working rollers, the flexible forming device may be provided with an upper frame and a lower frame. The lower frame is capable of moving all the working rollers as a whole, thus bringing the height positions of the working rollers to optimization. To reduce the distortion and anti-loose deformation of the flexible working rollers under the action of high torque, an anti-distortion and anti-loose device 11 can be installed in the non-forming area. After the adjusting process, a workpiece 2 can be placed in the flexible forming device and the flexible working roller 1 on the upper side can be pressed against the workpiece through the manipulation of the upper frame. When the working rollers rotate synchronously in the same direction and the workpiece is caused to move in the longitudinal direction, then the workpiece will be deformed in the longitudinal and transverse directions by increasing the press-down amount, so as to fulfill the three-dimensional surface forming. When the two segments of the working roller rotate synchronously in different directions, the workpiece will be caused to rotate and undergo a deformation process. When the two segments of the working roller rotate asynchronously, the workpiece will be moved in the longitudinal direction and will be rotated at the same time, and thus a complex deformation will be achieved.

Figure 10:
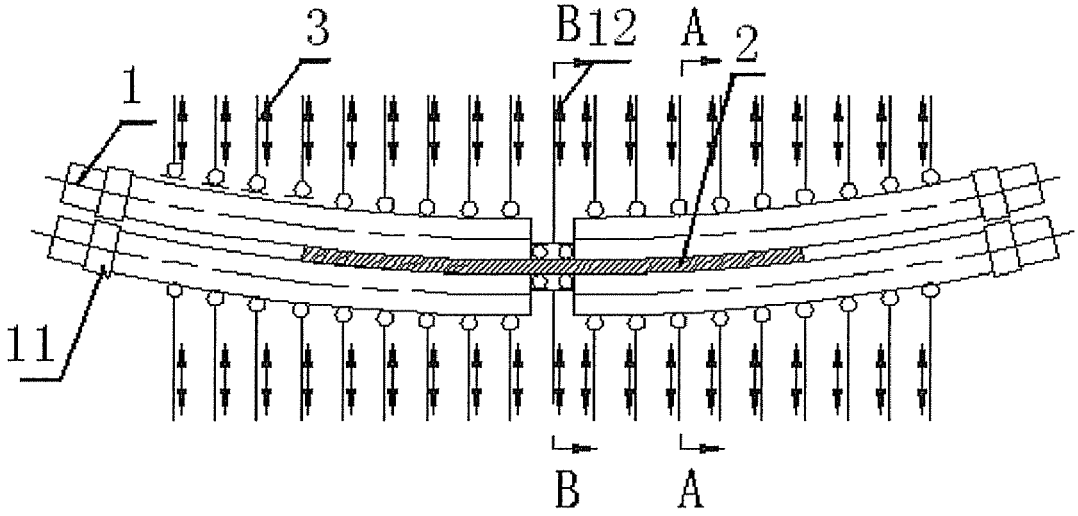
FIG. 10 is a schematic view of a flexible forming device composed of three bendable working rollers according to the second embodiment of the present invention, wherein each of the bendable working rollers is segmented into two segments, and there is a workpiece clamping and spinning mechanism between the two segments.

Referring to the embodiment in FIG. 10, the flexible working roller 1 on the upper side is pressed against the workpiece through manipulation of the upper frame. When the workpiece clamping and spinning mechanism 12 is not functioning, the forming process is shown in FIG. 9. The workpiece 2 will be rotated with the workpiece clamping and spinning mechanism 12 as its axis and undergo a deformation process when the workpiece is clamped by the workpiece clamping and spinning mechanism 12 and the two segments of the working rollers rotate synchronously in different directions under the action of the driving mechanism.

Figure 11:
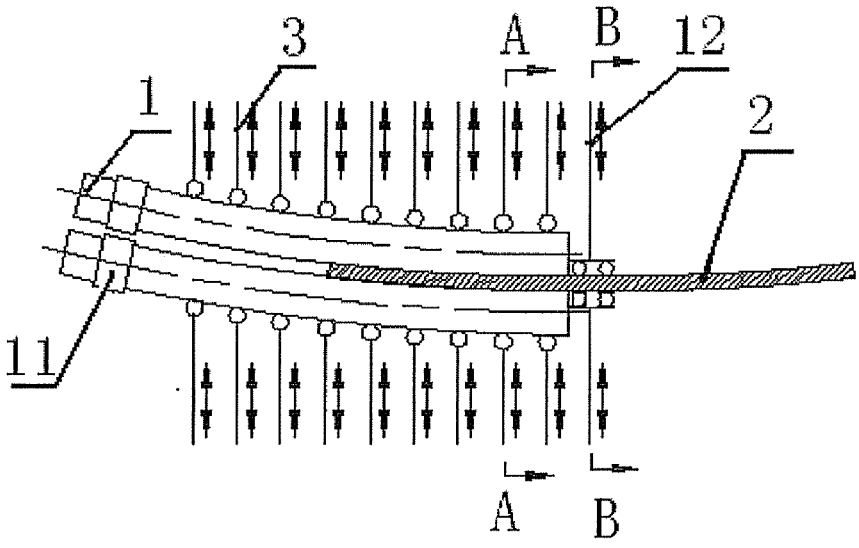
FIG. 11 is a schematic view of a portion of the flexible forming device composed of three bendable working rollers according to the second embodiment of the present invention, wherein each of the bendable working rollers is segmented into two segments, and there is a workpiece clamping and spinning mechanism between the two segments.
Figure 12:
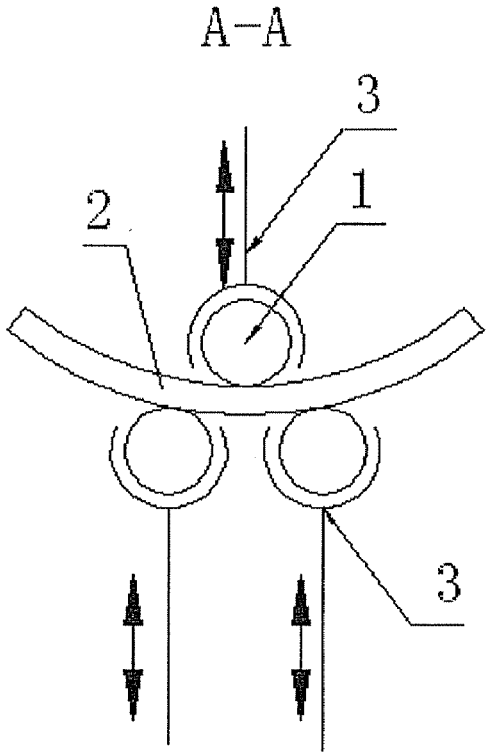
FIG. 12 is an A-A section view of FIG. 9, FIG. 10 and FIG. 11.
Figure 13:
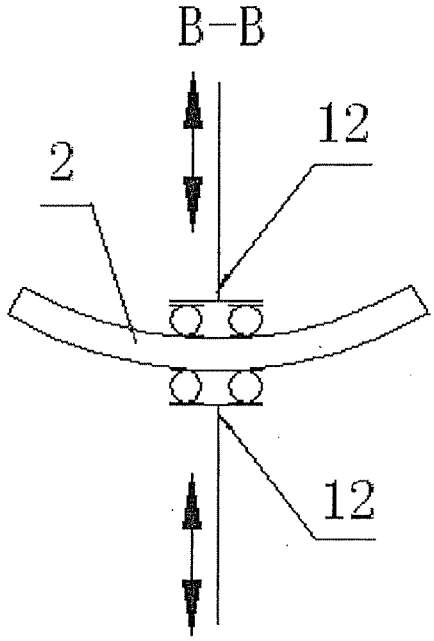
FIG. 13 is a B-B section view of FIG. 10 and FIG. 11.
Figure 14:
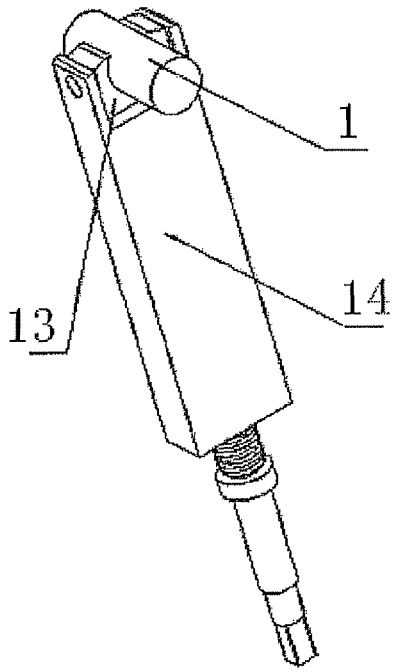
FIG. 14 is a three-dimensional diagram of an adjusting mechanism.
Figure 15:
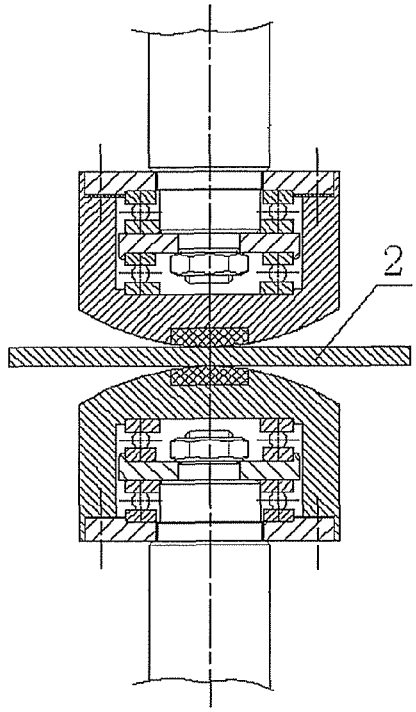
FIG. 15 is a section view of a workpiece clamping and spinning mechanism.

In the embodiment with reference to FIG. 11, the workpiece clamping and spinning mechanism 12 is pressed against the workpiece 2, and then the workpiece 2 can be caused to rotate with the workpiece clamping and spinning mechanism 12 as its axis and can be deformed. The A-A section view of FIGS. 9-11 is shown in FIG. 12, and the B-B section view of FIG. 10 and FIG. 11 are shown in FIG. 13.

Deformation and even successive forming of a workpiece 2 can be made through the pressing and spinning of the working rollers. The adjustment of the shape and amount of the deformation can be fulfilled by adjusting the bent degree and press-down amount of the working rollers.

As mentioned above, there should be at least two working rollers in the present invention, while the involvement of three working rollers can result in excellent forming effects. Of course, the more the number of working rollers are involved, the better the forming effects will be, and the arrangement of these working rollers can be set as required.

The flexible forming device according to the third embodiment of the present invention will be described below with reference to FIGS. 16-25, which distinguishes itself from those devices in the first and second embodiments in its exclusive application to tube-shaped and bar-shaped workpieces with variable diameters.

Figure 16:
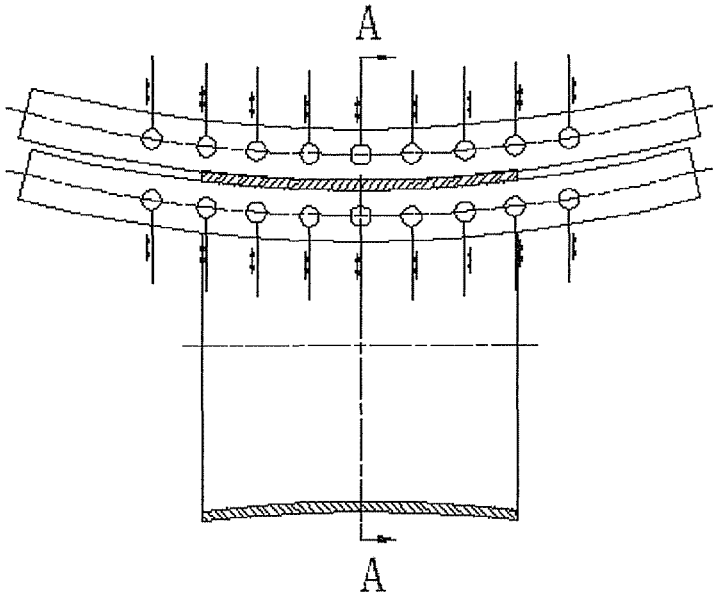
FIG. 16 is a schematic view of a flexible forming device used to process three-dimensional shaped workpieces through two bendable working rollers according to a third embodiment of the present invention.
Figure 17:
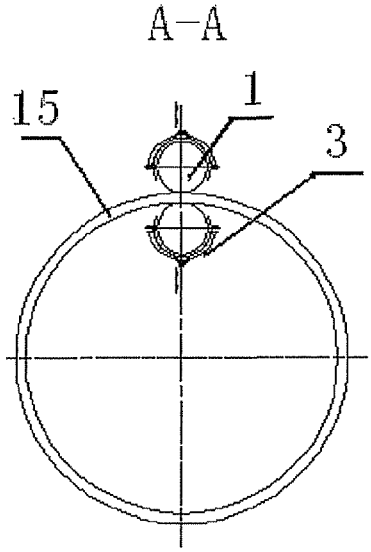
FIG. 17 is an A-A section view of FIG. 16.

The flexible forming device as shown in FIG. 16 comprises two bendable working rollers, which are arranged as shown in FIG. 17. The shape of the bendable working roller 1 can be adjusted through manipulation of an adjusting mechanism 3. Driving of the bendable working roller 1 can cause a synchronous rotation as well as a three-dimensional deformation of a tube-shaped or bar-shaped workpiece 15.

Figure 18:
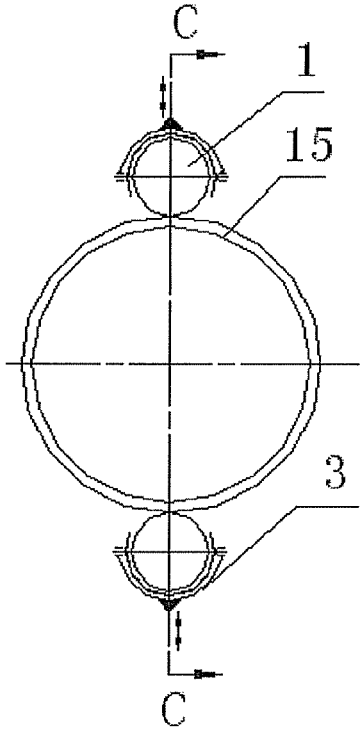
FIG. 18 and FIG. 19 are schematic views of flexible forming devices used to process three-dimensional workpieces to shrink or expand a diameter of the workpieces through two bendable working rollers according to the third embodiment of the present invention.
Figure 19:
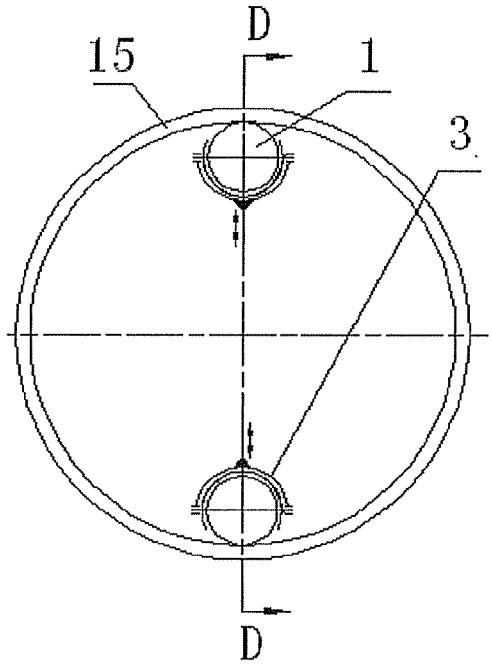

In the embodiment with reference to FIGS. 18 and 19, two bendable working rollers 1 can be arranged as required by different workpieces to be formed. According to the shape of the workpieces required, an adjusting mechanism 3 can be employed to regulate the shape of the bendable working roller 1, and the two working rollers undergo a centripetal or centrifugal movement and approach the outer surface of the tube-shaped or bar-shaped workpiece or the inner surface of the tube-shaped workpiece. In the meantime, driving the bendable working roller 1 can rotate a tube-shaped or bar-shaped workpiece 15 synchronously, thus causing a diameter expanding or shrinking deformation of the tube-shaped or bar-shaped workpiece 15.

Figure 20:
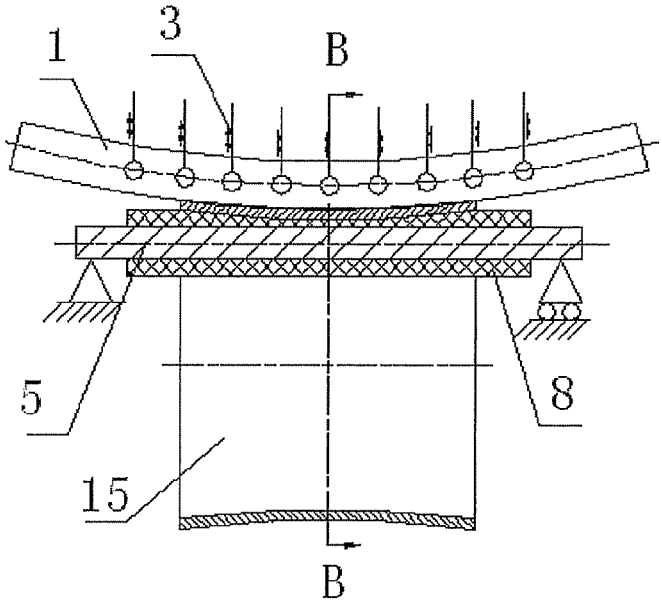
FIG. 20 is a schematic view of a flexible forming device used to process tube-shaped three-dimensional workpieces through a bendable working roller and a simple elastic roller according to the third embodiment of the present invention.
Figure 21:
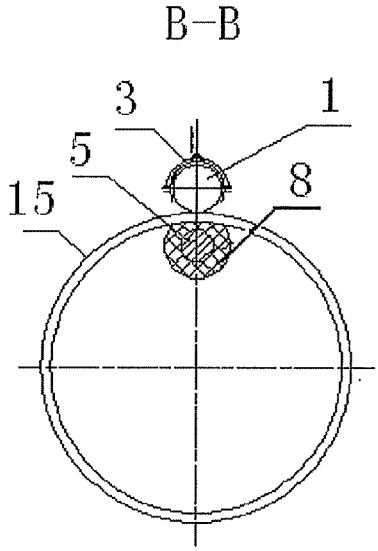
FIG. 21 is a B-B section view of FIG. 20.

In the embodiment shown in FIG. 20, a flexible forming device comprises a rigid working roller 5 with an elastic sleeve and a bendable working roller 1, which are arranged as shown in FIG. 21 and exercise pressure on the workpiece from both the internal and external sides. The shape of the bendable working roller 1 can be regulated through manipulation of an adjusting mechanism 3 according to the shape of the workpiece required. Driving of the bendable working roller can rotate a tube-shaped workpiece 15 synchronously, thus causing a three-dimensional deformation of the tube-shaped workpiece 15.

Figure 22:
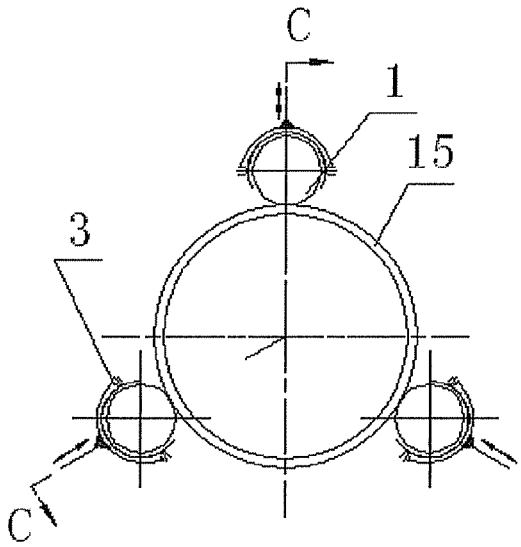
FIG. 22 and FIG. 23 are schematic views of flexible forming devices used to process three-dimensional shaped workpieces to shrink or expand a diameter of the workpieces through three bendable working rollers according to the third embodiment of the present invention.
Figure 23:
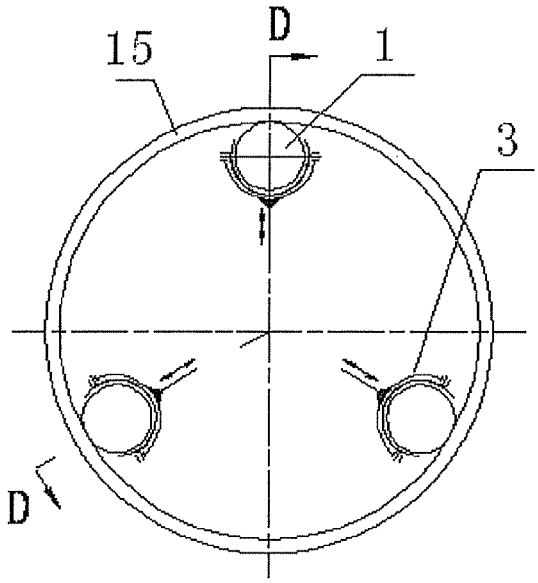
Figure 24:
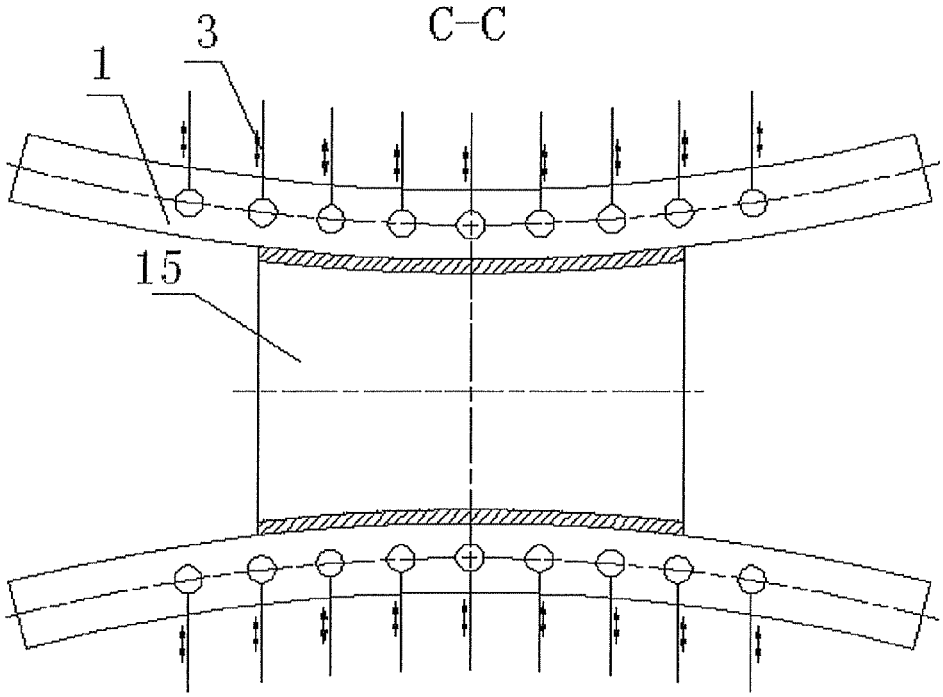
FIG. 24 is a C-C section view of FIG. 18 and FIG. 22.
Figure 25:
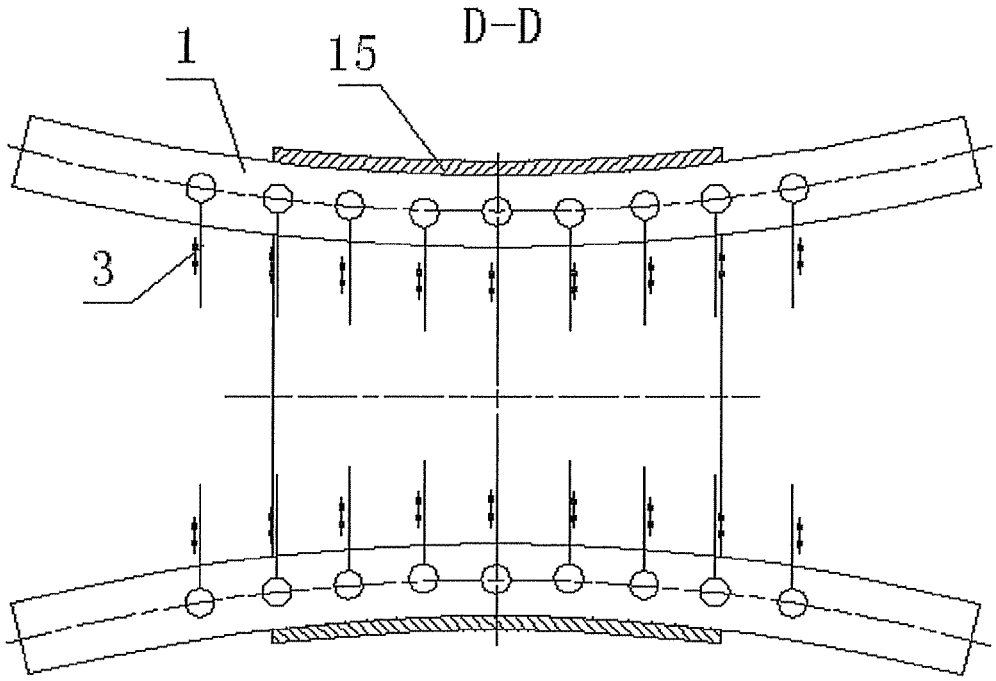
FIG. 25 is a D-D section view of FIG. 19 and FIG. 23.

In the embodiment shown with reference to FIGS. 22-25, a flexible forming device comprises three bendable working rollers 1, which are arranged as shown in FIG. 22 or 23 depending on different workpieces required to be formed. According to the shape of the workpiece required, the shape of the working rollers 1 can be regulated through an adjusting mechanism 3. The three working rollers undergo a centripetal or centrifugal movement and approach the outer surface of the tube-shaped or bar-shaped workpiece. In the meantime, driving of the bendable working rollers 1 can rotate the tube-shaped or bar-shaped workpiece 15 synchronously and gradually press the tube-shaped or bar-shaped workpiece 15 to cause a diameter expanding or shrinking deformation of the workpiece 15.

Similarly, the forming effect will be better if there are more working rollers, and in addition to the arrangement rules shown above, any other arrangements known to those skilled in the art or arrangements according to the actual requirement can be adopted. At least one of the working rollers shall be active, leaving the others to be passive or brake rollers. A flexible forming device with independently driven sub-rollers as shown FIGS. 26*a* and 26*b* comprises three flexible working rollers 1, which are arranged as shown in FIG. 26*b*. Each working roller comprises a plurality of sub-rollers, each of which can be regulated through an adjusting mechanism 16. Each sub-roller can cause a deformation of the workpiece in the longitudinal and transverse directions correspondingly. The arrangements of the sub-rollers can adopt any one of the various manners as shown in FIGS. 28*a*-29*c*, wherein the reference sign 17 refers to a sub-roller of metal material, the reference sign 18 refers to a hinged shaft, the reference sign 19 refers to a working roller driving means comprising a motor and a reducer, and the reference sign 20 refers to a sub-roller with a polyurethane rubber sleeve.

Figure 26A:
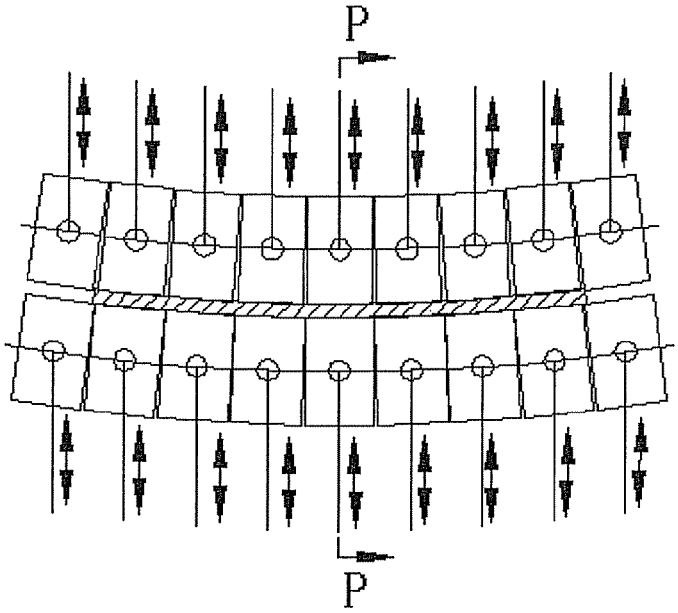
FIG. 26*a* is a schematic view of a flexible forming device having three sets of flexible working roller according to a fourth embodiment of the present invention.
Figure 26B:
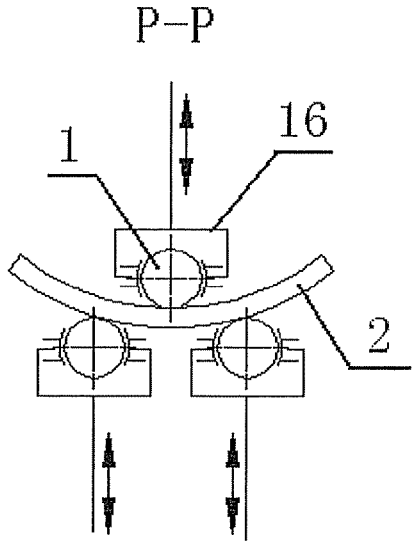
FIG. 26*b* is a P-P direction view of FIG. 26*a;*
Figure 27A:
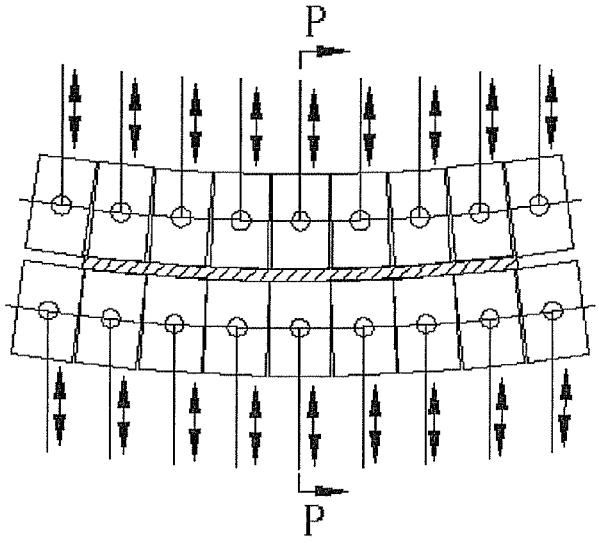
FIG. 27*a* is a schematic view of a flexible forming device having two sets of flexible working roller according to the fourth embodiment of the present invention.
Figure 27B:
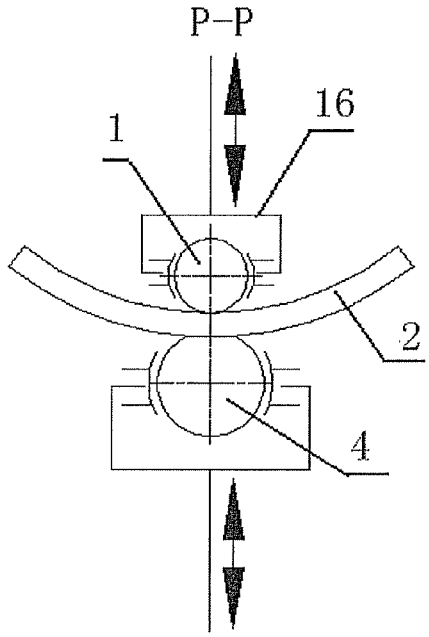
FIG. 27*b* is a P-P direction view of FIG. 27*a;*
Figure 28A:
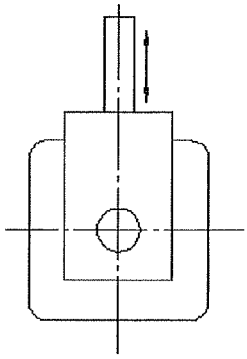
FIG. 28*a* is a schematic view of a sub-roller in FIG. 26*a* and FIG. 27*a*, wherein the surface of the sub-roller is made of steel or other metal materials.
Figure 28B:
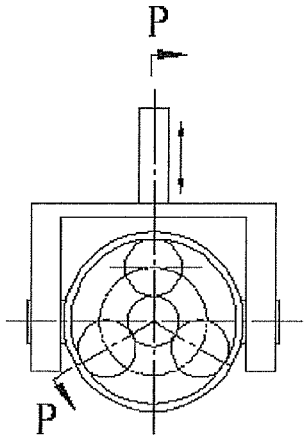
FIG. 28*b* is a side view of FIG. 28*a;*
Figure 28C:
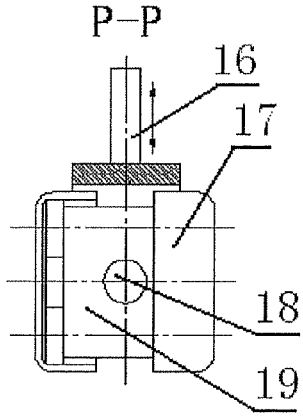
FIG. 28*c* is a P-P direction view of FIG. 28*b;*
Figure 29A:
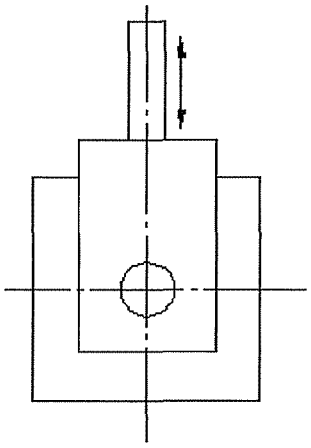
FIG. 29*a* is a schematic view of a sub-roller with a polyurethane rubber sleeve.
Figure 29B:
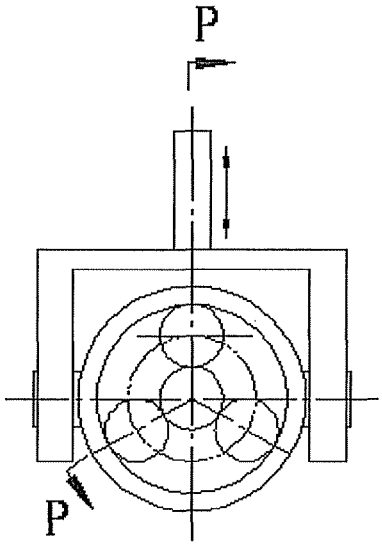
FIG. 29*b* is a side view of FIG. 29*a*.
Figure 29C:
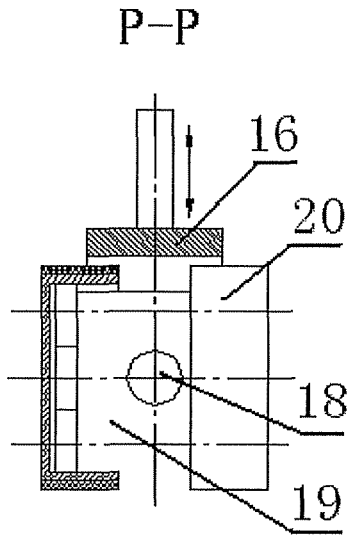
FIG. 29*c* is a P-P direction view of FIG. 29*b*.

The flexible forming device with independently driven sub-rollers as shown FIGS. 26*a* and 26*b* comprises three flexible working rollers 1, which are arranged according to the rule shown in FIG. 26*b*. Each working roller consists of a plurality of sub-rollers, each of which can be regulated through a adjusting mechanism 16, each sub-roller can cause a deformation of the workpiece in the longitudinal and transverse directions correspondingly; the arrangements of the sub-rollers can adopt any one of the various manners as shown in FIGS. 28*a*-29*c*, wherein the reference sign 17 refers to a sub-roller of metal material, the reference sign 18 refers to a hinged shaft, the reference sign 19 refers to a working roller driving means comprising a motor and a reducer, and the reference sign 20 refers to a sub-roller with a polyurethane rubber sleeve. A flexible forming device with independently driven sub-rollers shown in FIGS. 27*a* and 27*b* comprises a working roller 1 and a highly elastic working roller 4. The working roller 1 is composed of a plurality of sub-rollers, each of which can be regulated through an adjusting mechanism 16. The highly elastic working roller 4 can undergo a radial deformation under the action of the working roller 1, thus causing a deformation in the longitudinal and transverse directions of the workpiece.

The invention has been described in detail in combination with some embodiments as mentioned above. Obviously, the contents described above and shown in the drawings should be understood to be only illustrative, and not intended to limit the scope of the present invention. Various modifications or changes can be made on the basis of the concept of the present invention for one skilled in this field. For example, although some examples for forming plate-shaped, tube-shaped or bar-shaped workpieces using the flexible forming device have been shown, other three-dimensional shaped workpieces with complex shapes can also be processed by the flexible forming device of the invention. For example, although some illustrative embodiments with two or three working rollers are shown in the description, one skilled in this field can freely choose any other number numbers of working rollers as well as the arrangements thereof according to actual requirement. Obviously, all these changes or modifications will not depart from the scope of the present invention.

What is claimed is:

1. A flexible forming device for forming three-dimensional shaped workpieces, the flexible forming device comprising:

a frame;

at least two working rollers;

one or more working roller driving mechanisms; and one or more adjusting mechanisms;

wherein the working rollers, the one or more working roller driving mechanisms, and the one or more adjusting mechanisms are configured on the frame, respectively, such that a blank to be formed is clampable between the at least two working rollers, so that the blank is formable into a three-dimensional shaped workpiece under the rolling action of the working rollers; and wherein at least one of the working rollers comprises a flexible working roller, which is bendable and adjustable along an axis of the flexible working roller, and the flexible working roller comprises one or more materials selected from the group consisting of steel wire flexible axle, helical spring, steel wire, and polyurethane rubber.

2. The flexible forming device according to claim 1, wherein the flexible working roller comprises an integral working roller.

3. The flexible forming device according to claim 2, further comprising one or more workpiece clamping and spinning mechanisms whose comprising rotatable parts arranged at an end of the integral working roller, the rotatable parts being at least one of actively rotatable or passively rotatable.

4. The flexible forming device according to claim 1, wherein the at least two working rollers comprise two flexible working rollers that are positionable relative to a tube-shaped workpiece to be formed such that one of the flexible rollers is locatable on an outside of the tube-shaped workpiece to be formed, and the other flexible roller is locatable on an inside of the tube-shaped workpiece to be formed.

5. The flexible forming device according to claim 4, wherein the flexible working roller that is locatable on the inside of the tube-shaped workpiece to be formed comprises at least one of a passive bendable roller or a simple elastic roller.

6. The flexible forming device according to claim 1, wherein the at least two working rollers comprise at least two flexible working rollers, which are positionable on at least one of an inside or an outside of a workpiece to be formed, and arranged in a circumferential direction.

7. The flexible forming device according to claim 1, wherein the one or more adjusting mechanisms are arranged on the bendable and adjustable flexible working roller, the one or more adjusting mechanisms having adjustable height for supporting and adjusting an axis position and a bendable degree of the flexible working roller.

8. The flexible forming device according to claim 7, wherein each of the one or more adjusting mechanisms with adjustable height comprises an adjusting rod comprising two ends with an open bearing disposed on one end of the adjusting rod to adjust and support the flexible working roller, and the open bearing comprising a head and configured to swing the head in accordance with a change of a bending contour tangent of the flexible working roller.

9. The flexible forming device according to claim 1, wherein each of the at least two working rollers comprises two ends and the one or more working roller driving mechanisms are arranged on one or both ends of each of the at least two working rollers.

10. A flexible forming device for forming three-dimensional shaped workpieces, the flexible forming device comprising:

a frame; and at least two working rollers disposed on the frame with at least one of the working rollers comprising a flexible working roller, which is bendable and adjustable, the flexible working roller comprising a plurality of sub-rollers with each of the sub-rollers being independent from each of the other sub-rollers and having an adjustable axis position and a swayable axis angle; and wherein a blank to be formed is clampable between the at least two working rollers, so that the blank is formable into a three-dimensional shaped workpiece under the rolling action of the working rollers.

11. The flexible forming device according to claim 10, wherein the sub-rollers comprise rollers selected from a group consisting of an active sub-roller, a passive roller, and a brake roller.

12. The flexible forming device according to claim 1, wherein the at least two working rollers comprise a plurality of the flexible working rollers and the plurality of the flexible working rollers comprise rollers selected from a group consisting of an active roller, a passive roller, and a brake roller.

13. The flexible forming device according to claim 1, wherein the flexible working roller comprises a segmented working roller, segments in the segmented working roller being rotatable both synchronously and asynchronously in both a same direction and an opposite direction.

14. The flexible forming device according to claim 13, wherein the one or more workpiece clamping and spinning mechanisms comprise rotatable parts arranged between the segments of the segmented working roller, the rotatable parts being at least one of actively rotatable or passively rotatable.

* * * * *